US006280541B1

(12) United States Patent
Sudo et al.

(10) Patent No.: US 6,280,541 B1
(45) Date of Patent: Aug. 28, 2001

(54) SEAMLESS COPPER ALLOY TUBE FOR HEAT EXCHANGER BEING EXCELLENT IN 0.2% PROOF STRESS AND FATIGUE STRENGTH

(75) Inventors: Yuichiro Sudo; Tetsuo Yamaji, both of Omiya; Yutaka Saito, Kitamoto, all of (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/485,621

(22) PCT Filed: Jun. 11, 1999

(86) PCT No.: PCT/JP99/03118

§ 371 Date: Apr. 4, 2000

§ 102(e) Date: Apr. 4, 2000

(87) PCT Pub. No.: WO99/66087

PCT Pub. Date: Dec. 23, 1999

(30) Foreign Application Priority Data

Jun. 16, 1998 (JP) ..... 10/168443

(51) Int. Cl.[7] ..... C22C 9/06; C22C 9/00

(52) U.S. Cl. ..... 148/432; 420/496

(58) Field of Search ..... 148/432, 433, 148/434, 435, 436; 420/496

(56) References Cited

U.S. PATENT DOCUMENTS

| | | | | |
|---|---|---|---|---|
| 4,337,785 | * | 7/1982 | Sato et al. | 420/494 |
| 4,427,627 | | 1/1984 | Guerlet et al. | 420/496 |
| 5,147,469 | | 9/1992 | Kanzaki et al. | 148/684 |
| 5,205,878 | | 4/1993 | Kanzaki et al. | 148/684 |

OTHER PUBLICATIONS

Patent Abstracts of Japan, vol. 015, No. 429 (C–0880), Oct. 31, 1991, JP 03 180437, Aug. 6,1991.
Patent Abstract of Japan, vol. 012, No. 230 (C–508), Jun. 29, 1988, JP 63 026319, Feb. 3, 1988.

* cited by examiner

*Primary Examiner*—Sikyin Ip
(74) *Attorney, Agent, or Firm*—Oblon, Spivak, McClelland, Maier & Neustadt, P.C.

(57) ABSTRACT

A seamless pipe made of copper alloy consisting of, by weight % , a total amount of 0.02 to 0.2% of Co, 0.01 to 0.05% of P, 1 to 20 ppm of C if needed, and remainder Cu, and unavoidable impurities and, as said impurities, the total oxygen content is regulated to 50 ppm or less, and useful for a heat transfer pipe of a heat exchanger and especially, when HFC-type fluorocarbon is used as a heating medium.

10 Claims, No Drawings

SEAMLESS COPPER ALLOY TUBE FOR HEAT EXCHANGER BEING EXCELLENT IN 0.2% PROOF STRESS AND FATIGUE STRENGTH

This application is a 371 of PCT/JP99/03118, filed Jun. 11, 1999.

BACKGROUND OF THE INVENTION

Field of the Invention:

The present invention relates to a seamless copper alloy pipe having high 0.2% proof strength and fatigue strength which is mainly used for a heat transfer pipe of a heat exchanger and especially relates to said pipe which can be used as a heat transfer pipe when HFC-type fluorocarbon is used as a heating medium.

Discussion of the Background:

In general, a seamless pipe of phosphorus deoxidized copper has been used as a heat transfer pipe of a heat exchanger. In order to assemble the pipe of phosphorus deoxidized copper above to a heat transfer pipe of a heat exchanger, at first, said pipe should be cut to predetermined length and be formed to U character form by bending. After that, this U character formed pipe is passed into through holes of aluminum or aluminum alloy fins which are arranged in parallel and these fins are fixed on said pipe in parallel by extending a inside diameter of said pipe to pass through a plug or to load liquid pressure.

Moreover, the end of the U character formed pipe above is extended by flare forming and re-flare forming which is extending again the already flare formed end of the pipe and these extended ends are combined with other U character formed pipes by inserting one end of a not-extended U character formed pipe into the other extended end of pipe and soldering each other using a phosphorus copper solder.

After extending the end of pipe, when the end of U character formed pipe of usual phosphorus deoxidized copper is heated in soldering, crystal growth of copper alloy at heated area arises and, as a result, the strength of said heat influenced area which adjoins at soldered part may falls remarkably. As a seamless copper alloy pipe for a heat exchanger to prevent crystal growth above by soldering, a seamless copper alloy pipe made of phosphorus deoxidized copper with adding Fe is known. As such a conventional seamless copper alloy pipe being made of phosphorus deoxidized copper in which Fe is added as an indispensable component, for example, the following compositions are known. That is, a seamless copper alloy pipe for a heat exchanger being made of copper alloy comprising: the total amount of 0.005 to 0.8 weight % of Fe, 0.01 to 0.026% of P, 0.005 to 0.3% of Zr, 3 to 30 ppm of oxygen and remainder Cu (refer to Japanese Patent Laid-Open Nos. 39900/1983) and one comprising: 0.01 to 1.0 weight % of Fe, 0.005 to 0.6% of at least of one element selected from Cr, Si, Mn, As, Ni and Co, 0.005 to 0.6% of at least of one element selected from P, Ca and Mg, 0.004 to 0.04% of oxygen and remainder Cu (refer to Japanese Patent Laid-Open Nos. 156719/1977).

These seamless copper alloy pipes are assembled as heat transfer pipes of a heat exchanger and are filled up with a heating medium. The heat exchanger is operated by loading and opening wide condensation pressure to a heating medium. HCFC-type fluorocarbon has formerly been used as a heating medium above but HFC-type fluorocarbon is recently become to use since HCFC-type fluorocarbon contributes braking an ozone layer of earth and there are no fear about HFC-type fluorocarbon.

SUMMARY OF THE INVENTION

However, the condensation pressure at the time of using HFC-type fluorocarbon as a heating medium needs to be made larger than that of using the conventional HCFC-type fluorocarbon as a heating medium. For example, when R-22 which is typical one in HCFC-type fluorocarbon is used as a heating medium for a heat exchanger, it is enough that the condensation pressure of HCFC-type fluorocarbon in heat transfer tube is 20 kgf/cm$^2$. However, when R-410a which is typical one in HFC-type fluorocarbon is used as a heating medium, the condensation pressure in heat transfer pipe needs 31 kgf/cm$^2$ and this value is 1.5 times or more from the former value. Under the environment in which such high condensation pressure was loaded periodically, there were problems that cracks arose and broke the heat transfer pipe to become the possible cause of a trouble in long time use since 0.2% proof strength and fatigue strength of former heat transfer pipe were not enough, and that the characteristics of heat exchanger fell since the size of the heat transfer pipe largely changed because of shortage of 0.2% proof strength.

Means for Solving the Problems

In viewpoint of the above, the present inventors proceeded the research for the development of a seamless copper alloy pipe for a heat exchanger which is consisted by a copper alloy having excellent 0.2% proof strength and fatigue strength and the following knowledge was obtained.

(a) When Co was independently added 0.02 to 0.2% to phosphorus deoxidized copper, 0.2% proof strength and fatigue strength of copper alloy increased extremely, and electrical conductivity also increased.

(b) When carbon was added 1 to 20 ppm to phosphorus deoxidized copper with the addition of 0.02 to 0.2% of Co, 0.2% proof strength and fatigue strength of copper alloy furthermore increased.

(c) The content of P is preferably 0.01 to 0.5% and furthermore, an oxygen content as an unavoidable impurity is preferably regulated to 50 ppm or less.

The present invention was achieved based on the results set forth above and characterized as follow.

(1) A seamless pipe having high 0.2% proof strength and fatigue strength for a heat exchanger, the seamless pipe being made of copper alloy comprising: a total amount of 0.02 to 0.2 weight % of Co, 0.01 to 0.05% of P, remainder Cu, and unavoidable impurities and, as said impurities, the total oxygen content in said alloy is regulated to 50 ppm or less.

(2) A seamless pipe having high 0.2% proof strength and fatigue strength for a heat exchanger, the seamless pipe being made of copper alloy comprising: a total amount of 0.02 to 0.2 weight % of Co, 0.01 to 0.05% of P, 1 to 20 ppm of C, remainder Cu, and unavoidable impurities and, as said impurities, the total oxygen content of said alloy is regulated to 50 ppm or less.

In order to manufacture this seamless copper alloy pipe for a heat exchanger of the present invention, at first, usual electrolytic copper is melted under reducing atmosphere to make a molten low oxygen copper and next, Co and a mother alloy of Co and P are added to said molten copper to make a molten copper alloy. Furthermore, after adding predetermined amount of carbon as a mother alloy of Co and C to the molten copper alloy above if needed, said molten copper alloy is casted to make a columnar ingot.

This columnar ingot above is heated to a predetermined temperature within the range from 850° C. to 1050° C. and is formed by a extrusion into water. Furthermore, cold working and annealing are done to make a seamless copper alloy pipe for a heat exchanger having a predetermined cross-sectional size.

There is described next the reason why the composition of the copper alloy for a seamless pipe of a heat exchanger according to the invention is defined as above.

(a) Co

Co is dissolved into the matrix of phosphorus deoxidized copper or forms phosphorous compound phases and is an effective component which enhances 0.2% proof strength and fatigue strength of copper alloy above. When the Co content is over 0.2%, electrical conductivity of copper alloy above becomes less than 70% IACS and thermal conductivity falls. Whereas, when the Co content is less than 0.01%, a desired effect is not obtained. Therefore, the Co content is determined to 0.02% to 0.2% and preferably 0.04% to 0.1%.

(b)P

P has the work which makes crystal grain finer by coexisting with Co and therefore, enhances 0.2% proof strength and fatigue strength. When the P content is over 0.05%, electrical conductivity of copper alloy above decreases remarkably. Whereas, when the P content is less than 0.01%, a desired effect is not obtained. Therefore, the P content is determined to 0.01% to 0.05% and preferably 0.015% to 0.04%.

(c) Oxygen

Oxygen is contained as an unavoidable impurity. When the oxygen content is over 50 ppm, a coarse oxide is formed in copper alloy above and, as a result, 0.2% proof strength and fatigue strength are decreased. Therefore, the oxygen content in a seamless copper alloy pipe for a heat exchanger is determined to be 50 ppm or less and preferably 10 ppm or less.

(d)C

C is added to the copper alloy above to arise 0.2% proof strength and fatigue strength much more, if needed. When C is added over 20 ppm, it becomes difficult to melt and cast the copper alloy above in conventional methods. Whereas, when the C content is less than 1 ppm, a desired effect is not obtained. Therefore, the C content is determined to 1 ppm to 20 ppm and preferably 1 ppm to 5 ppm.

BRIEF DESCRIPTION OF THE PREFERRED EMBODIMENTS

After preparing an electrolytic copper as a raw material, said copper was melted under reducing atmosphere to make a molten low oxygen copper in which the oxygen content was 50 ppm or less and Co and a mother alloy of copper and 15% P were added to said molten copper. Furthermore, a predetermined quantity of a mother alloy of Co and 1% C was added if needed and, as a result, a molten copper alloy was prepared. The molten copper alloy above was casted into the mold to make columnar ingots having a dimension with a diameter of 320 mm and a length of 710 mm and an element composition shown in Table I to Table 3.

After this columnar copper alloy ingots above were heated under a condition to keep at 950° C. for 1 hour by a billet heater, solution treatment and making original pipes having a dimension with a diameter of 100 mm and a thickness of 10 mm were simultaneously performed by extrusion into a water.

Furthermore, a cold working was carried out to such original pipes above to make seamless pipes having a dimension with an inner diameter of 6.5 mm and a thickness of 0.25 mm. The obtained seamless copper alloy pipes above were annealed at 550° C. for 1 hour in a bright annealing furnace and, as a result, the seamless copper alloy pipes for a heat exchanger (hereinafter referred to as present invention pipes) of No. 1 to No. 14 and comparative seamless copper alloy pipes (hereinafter referred to as comparative pipes) of No. 1 to No. 5 were manufactured. Furthermore, conventional seamless copper alloy pipes in which elemental composition is shown in Table 3 and Fe was contained as an indispensable component (hereinafter referred to as conventional pipes) of No. 1 to No. 3 were prepared.

The fatigue strength of these present invention pipes of No. 1 to No. 14, comparative pipes of No. 1 to No. 5 and conventional pipes of No. 1 to No. 3 were measured by monitoring of the existence of a crack initiation on said pipes when periodical internal pressure, i.e. 60 kgf/cm$^2$, was loaded and opened wide of $2\times10^7$ times from one opened ends of said pipes of which the other ends were closed. These results are shown in Table 1 to Table 3 and evaluated.

Furthermore, 0.2% proof strength and elongation were measured by a tensile test being a method according to JIS Z 2241 in which the tensile specimens having the same composition of the present invention pipes of No. 1 to No. 14, comparative pipes of No. 1 to No. 5 and conventional pipes of No. 1 to No. 3 were used. These results are shown in Table 1 to Table 3. Furthermore, the electrical conductivity of these copper alloys were measured by a four probe method being a method according to JIS C 3001 using 1 m of measuring length. These results are also shown in Table 1 to Table 3 and heat-conducting characteristics were evaluated.

Advantages

From the results of Table 1 to Table 3, all of the present invention pipes of No. 1 to No. 14 have not a crack initiation under a periodical internal pressure of $2\times10^7$ times. However, all of the conventional pipes of No. 1 to No. 3 have a crack initiation under a periodical internal pressure of $1\times10^6$ times or less. These results indicate that the present invention pipes of No. 1 to No. 14 are excellent in fatigue strength as compared with the conventional pipes of No. 1 to No.3. Moreover, elongation of the present invent-ion of No. 1 to No. 14 does not have a marked difference as compared with conventional pipes of No. 1 to No. 3. However, all of the present invention pipes of No. 1 to No. 14 are excellent in 0.2% proof strength as compared with the conventional pipes of No. 1 to No. 3 and moreover, it can be understand that the electrical conductivity of the present invention pipes increased.

However, the comparative pipes of No. 1 to No. 5 which have a composition separating from the claim of this invention show at least one undesirable characteristics selected from fatigue strength, 0.2% proof strength, elongation and electrical conductivity as a seamless copper alloy pipe for a heat exchanger.

As described above, a seamless copper alloy pipe for a heat exchanger according to this invention is effective for a heat transfer pipe since it has especially excellent fatigue strength and 0.2% proof strength. Especially, the copper alloy pipes in the present invention can highly contribute to the spread of the heat exchanger which uses HFC-type fluorocarbon as a heating medium.

TABLE 1

| No. | Element Composition (weight %) Remainder: Cu and unavoidable impurities Co | P | C (ppm) | O (ppm) | Fe | Existence of a crack initiation when internal pressure is loaded periodically | 0.2% proof strength (kgf/mm$^2$) | Elongation (%) | Electrical Conductivity % LACS |
|---|---|---|---|---|---|---|---|---|---|
| Present Invention Pipe | | | | | | | | | |
| 1 | 0.05 | 0.03 | — | 30 | — | Nothing | 18.3 | 43.8 | 86.4 |
| 2 | 0.08 | 0.03 | — | 30 | — | Nothing | 19.1 | 42.6 | 85.3 |
| 3 | 0.10 | 0.03 | — | 30 | — | Nothing | 19.2 | 42.3 | 85.6 |
| 4 | 0.14 | 0.02 | — | 30 | — | Nothing | 19.5 | 39.8 | 85.1 |
| 5 | 0.19 | 0.04 | — | 30 | — | Nothing | 19.8 | 39.1 | 86.2 |
| 6 | 0.11 | 0.05 | — | 30 | — | Nothing | 19.1 | 40.3 | 85.8 |
| 7 | 0.02 | 0.02 | — | 30 | — | Nothing | 18.1 | 46.1 | 89.2 |

TABLE 2

| No. | Element Composition (weight %) Remainder: Cu and unavoidable impurities Co | P | C (ppm) | O (ppm) | Fe | Existence of a crack initiation when internal pressure is loaded periodically | 0.2% proof strength (kgf/mm$^2$) | Elongation (%) | Electrical Conductivity % LACS |
|---|---|---|---|---|---|---|---|---|---|
| Present Invention Pipe | | | | | | | | | |
| 8 | 0.16 | 0.04 | 5 | 30 | — | Nothing | 22.4 | 40.3 | 85.3 |
| 9 | 0.07 | 0.03 | 10 | 30 | — | Nothing | 22.3 | 43.1 | 85.8 |
| 10 | 0.09 | 0.03 | 4 | 30 | — | Nothing | 21.1 | 42.1 | 86.3 |
| 11 | 0.14 | 0.02 | 2 | 30 | — | Nothing | 21.4 | 40.3 | 85.2 |
| 12 | 0.20 | 0.04 | 1 | 30 | — | Nothing | 20.2 | 41.1 | 86.1 |
| 13 | 0.12 | 0.04 | 19 | 30 | — | Nothing | 22.5 | 41.3 | 85.2 |
| 14 | 0.03 | 0.02 | 15 | 30 | — | Nothing | 20.1 | 45.2 | 88.5 |

TABLE 3

| No. | Element Composition (weight %) Remainder: Cu and unavoidable impurities Co | P | C (ppm) | O (ppm) | Fe | Existence of a crack initiation when internal pressure is loaded periodically | 0.2% proof strength (kgf/mm$^2$) | Elongation (%) | Electrical Conductivity % LACS |
|---|---|---|---|---|---|---|---|---|---|
| Comparative Pipe | | | | | | | | | |
| 1 | *0.007 | 0.04 | — | 80 | — | Crack arose at $1 \times 10^5$ times | 9.1 | 41.6 | 80.5 |
| 2 | *0.70 | 0.03 | — | 30 | — | Nothing | 20.3 | 34.1 | 65.6 |
| 3 | 0.10 | 0.03 | — | *30 | — | Crack arose at $1 \times 10^6$ times | 14.7 | 38.2 | 86.2 |
| 4 | 0.14 | *0.005 | — | 30 | — | Crack arose at $2 \times 10^5$ times | 12.1 | 42.6 | 72.3 |
| 5 | 0.09 | *0.06 | — | 30 | — | Nothing | 18.2 | 36.3 | 67.2 |
| Conventional Pipe | | | | | | | | | |
| 1 | 0.1 | 0.03 | — | 30 | *0.1 | Crack arose at $2 \times 10^6$ times | 13.8 | 38.4 | 74.8 |
| 2 | *— | 0.03 | — | 30 | *0.1 | Crack arose at $4 \times 10^5$ times | 9.8 | 39.0 | 78.2 |
| 3 | *— | 0.03 | — | 30 | — | Crack arose at $1 \times 10^5$ times | 6.7 | 42.3 | 82.4 |

What is claimed is:

1. A seamless pipe having high 0.2% proof strength and fatigue strength for a heat exchanger, the seamless pipe being made of copper alloy consisting of:

a total amount of 0.02 to 0.2 weight % of Co, 0.01 to 0.05% of P, remainder Cu, and unavoidable impurities and, as said impurities, the total oxygen content in said alloy is regulated to 50 ppm or less.

2. A seamless pipe having high 0.2% proof strength and fatigue strength for a heat exchanger, the seamless pipe being made of copper alloy consisting of:

a total amount of 0.02 to 0.2 weight % of Co, 0.01 to 0.05% of P, 1 to 20 ppm of C, remainder Cu, and unavoidable impurities and, as said impurities, the total oxygen content in said alloy is regulated to 50 ppm or less.

3. The seamless pipe of claim 1, wherein the amount of Co is 0.04% to 0.1% by weight.

4. The seamless pipe of claim 1, wherein the amount of P is 0.015% to 0.04% by weight.

5. The seamless pipe of claim 1, wherein the total oxygen content is 10 ppm or less.

6. The seamless pipe of claim 2, wherein the amount of C is 1 to 5 ppm.

7. The seamless pipe of claim 3, wherein the amount of P is 0.015% to 0.04% by weight.

8. The seamless pipe of claim 3, wherein the total oxygen content is 10 ppm or less.

9. The seamless pipe of claim 4, wherein the total oxygen content is 10 ppm or less.

10. The seamless pipe of claim 7, wherein the total oxygen content is 10 ppm or less.

* * * * *